US006827073B1

(12) United States Patent
Morrell

(10) Patent No.: US 6,827,073 B1
(45) Date of Patent: Dec. 7, 2004

(54) BLOCK SPLITTING TOOL

(76) Inventor: Kelly J. Morrell, 8350 Decathlon Dr., Spicer, MN (US) 56288

( * ) Notice: Subject to any disclaimer, the term of this patent is extended or adjusted under 35 U.S.C. 154(b) by 0 days.

(21) Appl. No.: 10/368,936

(22) Filed: Feb. 20, 2003

(51) Int. Cl.[7] ..... B28D 1/32

(52) U.S. Cl. ..... 125/23.01; 125/24; 125/41; 125/12; 125/16.04

(58) Field of Search ..... 125/12, 16.04, 125/18, 23.01, 23.02, 22, 24, 35, 40, 41; 225/97; 83/55, 694; 76/107.8

(56) References Cited

U.S. PATENT DOCUMENTS

| | | | | | |
|---|---|---|---|---|---|
| 2,657,681 | A | * | 11/1953 | Gatzke | 125/23.01 |
| 3,392,719 | A | * | 7/1968 | Clanton et al. | 125/23.01 |
| 3,492,984 | A | * | 2/1970 | Harper | 125/23.01 |
| 4,802,836 | A | * | 2/1989 | Whissell | 425/253 |
| 4,848,309 | A | * | 7/1989 | Alderete | 15/40 |
| 5,066,070 | A | * | 11/1991 | Clarke | 299/37.4 |
| 5,662,094 | A | * | 9/1997 | Giacomelli | 125/23.01 |
| 5,662,386 | A | * | 9/1997 | Newman et al. | 299/37.5 |
| 5,722,386 | A | * | 3/1998 | Fladgard et al. | 125/23.01 |
| 6,029,943 | A | | 2/2000 | Sievert | |
| 6,050,255 | A | | 4/2000 | Sievert | |
| 6,082,057 | A | | 7/2000 | Sievert | |
| 6,178,704 | B1 | | 1/2001 | Sievert | |
| 6,321,740 | B1 | | 11/2001 | Scherer et al. | |
| 6,502,569 | B1 | * | 1/2003 | Lee | 125/23.01 |
| 2002/0092257 | A1 | | 7/2002 | Scherer et al. | |

* cited by examiner

*Primary Examiner*—George Nguyen
(74) *Attorney, Agent, or Firm*—Moore, Hansen & Sumner

(57) ABSTRACT

A block splitting tool having a splitting blade that is formed by edges of a plurality of smaller splitter segments. The splitter segments are arranged in a side-by-side relation such that the edges form a substantially continuous blade that is generally corrugated or jagged. The splitter segments may be operatively connected to a suitable support that, in turn, is attached to a block splitting machine. When the splitting blade of the tool engages and splits a block, the edges of the splitter segments form a plurality of fracture zones that are angled with respect to each other, which results in roughened facings on the newly cleaved smaller blocks. In a preferred embodiment, the splitter segments are removably attached to a support plate, so that they may be repositioned, replaced, and/or repaired.

18 Claims, 2 Drawing Sheets

BLOCK SPLITTING TOOL

FIELD OF THE INVENTION

The present invention generally relates to masonry blocks. More particularly, the present invention relates to tool for creating roughened facings on retaining wall blocks when the blocks are being cleaved or split.

BACKGROUND OF INVENTION

The manufacture of masonry blocks has been known for many years. Originally produced by casting individual blocks in single molds, advances in technology have led to production techniques that are able to produce multiple blocks not only from a mold matrix, but also from a single mold in which individual blocks are formed by splitting the molded block along a predetermined plane or planes, as the case may be. Production of multiple blocks from a single mold is preferred because the mold itself is simpler to design and build, fewer parts are required, and the blocks so produced are symmetrical, which facilitates later assembly into structures. Moreover, the blocks so produced have aesthetically pleasing split facings that are evocative of quarrying techniques and old world craftsmanship.

Sometimes, the aforementioned blocks are further processed by mechanically working the facings of the blocks so that they appear weathered and old. This can be achieved by tumbling, by mechanical working with flails or hammermills, or by providing additional hand dressing, for example. As one may imagine, such steps add to the total production time and expense. Moreover, additional machinery and training is usually required, which is usually factored into the cost of the finished product.

Thus, there is a need for tool that is able to produce a masonry block with a "weathered" facing. There is also a need for a tool that reduces the number of steps that are used to produce weathered facings on masonry blocks. There is yet a need for a block splitting tool that is easy to manufacture, assemble, repair, and reconfigure.

SUMMARY OF THE INVENTION

This invention is directed to a tool for splitting a large block of material into a plurality of smaller blocks having predetermined dimensions. A preferred embodiment of the tool comprises a plurality of splitter segments, each having a material working or splitting edge. The splitter segments are affixed to a suitable support so that their working edges form a generally continuous and corrugated splitting blade. With this embodiment, the splitter or splitting blade is able to form blocks that have roughened or weathered facings; however, it will be appreciated that other configurations are possible.

Another preferred embodiment of the tool comprises a plurality of removable and/or positionable splitter segments, each of which is provided with a material working edge. The splitter segments are attached to a suitable support and arranged so that the working edges of the splitter segments form a substantially continuous splitting blade. Preferably, the working edges of the splitter segments are positioned with respect to each other so that the resultant splitting blade is generally corrugated rather than linear.

The tool may be mounted on a movable crosshead of a conventional block splitter such that movement of the splitting blade is substantially perpendicular to a block to be split. A second tool having a second splitting blade may also be used, and it too may be mounted on a conventional, movable crosshead such that the second splitting blade is in opposing relation to the splitting blade of the first tool, and the motion of the crossheads define a working plane. Preferably, the first and second splitting blades are mirror images of each other, though this need not be necessarily so.

An object of the present invention is to provide a tool for splitting a larger block of material into a plurality of smaller blocks.

Another object of the invention is to simplify the process of producing weathered or roughened facings in masonry blocks.

Yet another object of the present invention is to reduce the number of parts needed to produce weathered facings in masonry blocks.

A feature of the present invention is that the tool comprises a plurality of smaller segments that are positioned together in a side-by-side and substantially continuous relation.

Another feature of the present invention is that the segments of the tool are removably positionable.

An advantage of the invention is that the tool may be easily reconfigured by repositioning the segments relative to each other.

Another advantage of the invention is that the tool may be used with existing machinery without modifications or adaptors.

These and other objects, features and advantages of the present invention will become apparent from the following detailed description thereof taken in conjunction with the accompanying drawings, wherein like reference numerals designate like elements throughout the several views.

DETAILED DESCRIPTION OF THE INVENTION

Figure 1:
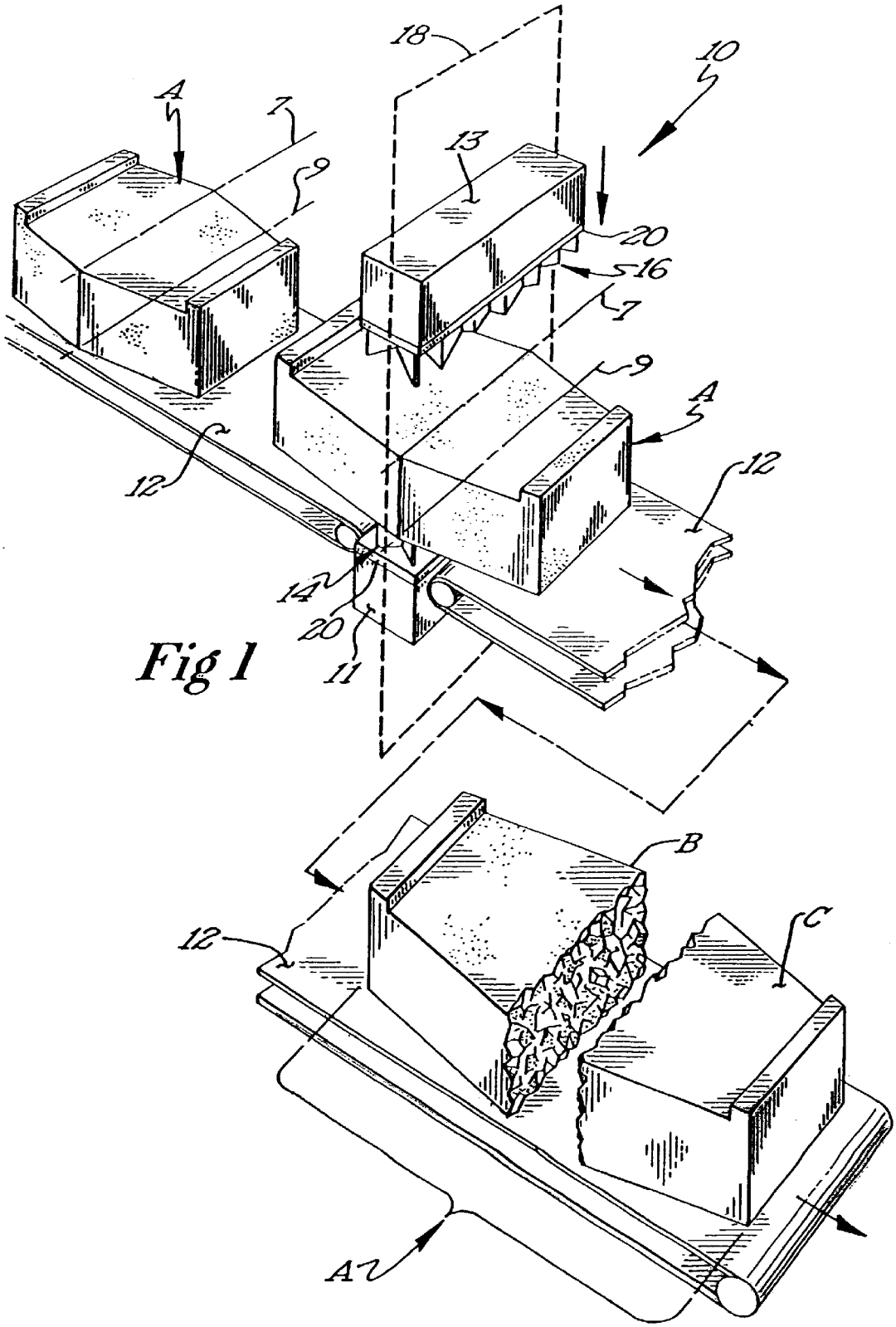
FIG. 1 is a partial perspective view of a splitting station in which opposing splitting tools are used to split a block into smaller blocks.

FIG. 1 depicts a workstation 10 where a large block may be split into smaller blocks. Starting from the upper left, a symmetrically shaped, molded block A is positioned on a conveyer 12 that leads it to a point where the block is split into smaller blocks B, C by the splitting tools 14, 16 of the present invention. As shown, the splitting tools 14, 16 are positioned and arranged so that they engage a block from opposing directions. The splitting tools may be removably attached to crossheads 11, 13 of a splitter machine (not shown) for reciprocal motion towards and away from each other. It will be understood that the reciprocal motion of the splitting tools define a working or splitting plane 18 that is generally perpendicular to the block being split. As depicted at the bottom of the figure, block A has been split along an axis of symmetry 7, which results in two similarly sized and shaped blocks B, C. It will be appreciated, however, that the block may be split along asymmetric axes to produce differently sized and shaped blocks. Such an asymmetric axis 9 is also shown in FIG. 1.

Figure 2:
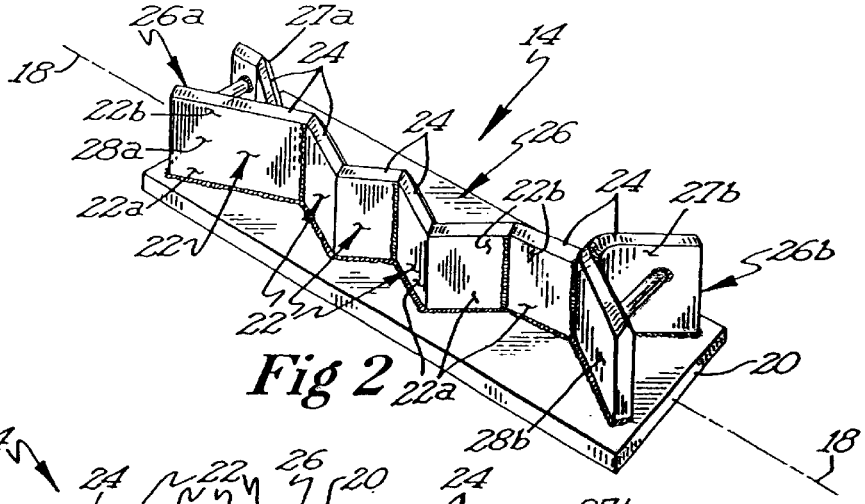
FIG. 2 is a perspective view of the one of the splitting tools of FIG. 1.

One of the splitting tools 14 of FIG. 1 is depicted in greater detail in FIG. 2. As shown, the splitting tool 14 comprises a support 20 upon which a plurality of splitter segments 22 are affixed. Each splitter segment 22 comprises a body having a root end 22*a* and a crown end 22*b*, with the root end being attached to the support, and the crown end terminating in a material working or splitting edge 24. Each splitter segment 22 has a predetermined height, width, and thickness, and as shown the height and thickness of the splitter segments are substantially the same, while the widths are different. It will be appreciated, however, that the dimensions of the splitter elements may be varied without departing from the spirit and scope of the invention.

The splitter segments 22 are affixed to the support using known techniques and technologies, such as welding. The splitter segments may also be linked to each other at their sides, again using known techniques and technologies. However, it will be appreciated that the splitter segments need not be attached to each other at their sides in order for the splitting tool to operate effectively as a splitting blade, and there may even be small spaces between adjacent splitter segments. Generally, though, it is preferred that the splitter segments be in abutting contact with each other to form an uninterrupted splitting blade because it results in a stronger tool structure. As depicted, each splitter segment 22 is affixed to the support 20 such that its material working or splitting edge 24 extends therefrom in a substantially perpendicular relation to the support. The splitter segments are angled with respect to each other and with respect to the splitting plane to form a generally corrugated splitting blade generally indicated by reference numeral 26, with the splitting blade having first and second ends 26*a* and 26*b*. The corrugated splitting blade 26 is able to produce a roughened or "weathered" facing because each edge 24 of each splitter segment creates its own localized fracture zone when it engages a block.

Figure 3:
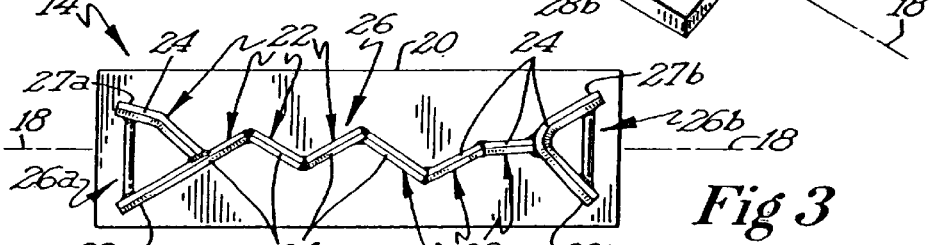
FIG. 3 is a plan view of the splitting tool of FIG. 2.
Figure 4:
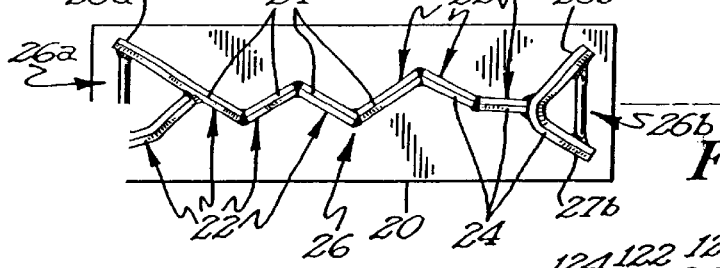
FIG. 4 is a plan view of a second splitting tool in juxtaposition with the splitting tool of FIG. 3.

Referring to FIGS. 3 and 4, a pair of opposed splitting tools 14 and 16 are shown in juxtaposition, with the splitting blades of the opposing splitting tools being mirror images of each other. It will be appreciated that it is not necessary for the splitting blades to be mirror images of each other and it is envisioned, for example, that the opposing blades may have substantially different configurations. Moreover, it is also envisioned that the splitter segments 22 need not be planar and could be configured in other shapes such as arcs or angles, for example. Note that while the angles defined by the intersection of pairs of adjacent splitter segments are different, they could be more uniform without departing from the spirit and scope of the invention. It is preferred, however, that the angles be different from each other because it is believed that they facilitate the creation of a more roughened or weathered facing, and increase the randomness of the block facings.

As can be seen, the splitting blades 26 are oriented generally along the working plane 18 as defined by the motion of the crossheads 11, 13 (see, FIG. 1). Each splitting blade 26 has two ends 26*a* and 26*b*, each of which is optionally bifurcated into end segments 27*a*, 28*a*, and 27*b*, 28*b*. It will be understood that such bifurcations will produce a block that has rounded side facing edges, which create a more roughened or "weathered" look. In keeping with the goal of achieving a roughened or "weathered" look, it will be appreciated that the material working edges are arranged so that the edges are in a distinct angular orientation with respect to the working or splitting plane (see, FIGS. 3 and 4). This reduces the chance that the facings so produced will have what is perceived as a facet. The blade segments 22 are positioned along the splitting plane 18 and are preferably oriented so that substantially all of the blade segments intersect plane 18.

Figure 5:
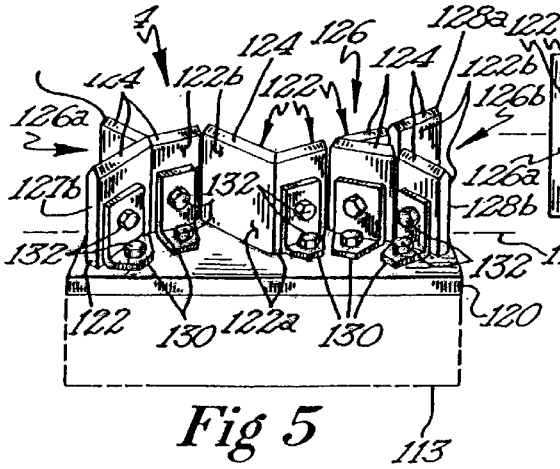
FIG. 5 is a perspective view of an alternative embodiment of a splitting tool; and, FIG. 6 is a top plan view of the splitting tool of FIG. 5.
Figure 6:
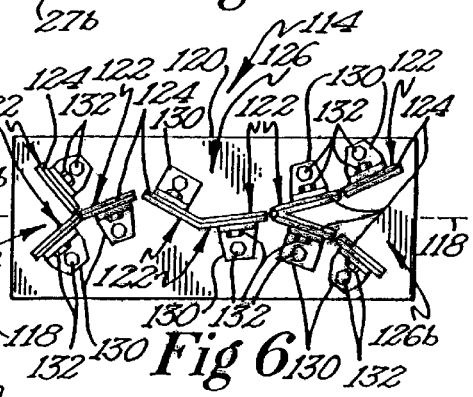

A second embodiment of the present invention is depicted in FIGS. 5 and 6. While only one splitting tool 114 is depicted, it will be understood that the splitting process is better achieved by using a second oppositely disposed, splitting tool (see, FIGS. 1 and 3). Referring to FIG. 5, the splitting tool 114 as shown comprises a support or base mounted on a crosshead 113 (shown in dashed lines) and upon which a plurality of splitter segments 122 are attached, with each splitter segment 122 comprising a body having a root end 122*a* and a crown end 122*b*, and with the root end being attached to the support 120 and the crown end terminating in a material working or splitting edge 124. Each splitter segment 122 has a predetermined height, width, and thickness, and as shown the height and thickness of the splitter segments are substantially the same, while the widths are different. It will be appreciated, however, that the dimensional characteristics of the splitter elements may be varied without departing from the spirit and scope of the invention.

The splitter segments 122 may be removably attached to the support 120 using known technologies and techniques. Preferably, L-shaped brackets 130 and threaded fasteners 132 such as cap screws are used to secure the splitter segments 122 to the support 120. It will be appreciated that other forms of attachment may be used. For example, the splitter segments could be bolted directly to the support. This allows individual splitter segments to be attached, removed, rearranged, or repaired. As will be appreciated, the splitter segments need not contact each other at their sides in order for the splitting tool to operate effectively as a splitting blade, and there may even be small spaces between adjacent splitter segments 122. Generally, though, it is preferred that the splitter segments be positioned so that their sides are in close proximity to, or in abutting contact with each other to form an uninterrupted splitting blade. As depicted, each splitter segment is affixed to the support such that its material working or splitting edge 124 extends therefrom in a substantially perpendicular relation, and the splitter segments 122 are angled with respect to each other, to form a splitting blade 126 having first and second ends 126*a* and 126*b*. Note that splitter segments are alternately angled with respect to each other and with respect to the splitting plane in a corrugated configuration. The splitting blade 126 is able to produce a roughened or "weathered" facing because each edge 124 of each splitter segment 122 creates its own localized fracture zone when it engages a block.

Referring to FIGS. 5 and 6, only one splitting tool is shown; however, it is understood that an additional, similarly configured, and arranged splitting tool could be used, as depicted in FIGS. 1, 3 and 4. As with the embodiment as depicted in FIGS. 3 and 4, it will be appreciated that it is not necessary for the splitting blades to be mirror images of each other and it is contemplated that the opposing blades may have substantially different configurations. Moreover, it is also envisioned that the splitter segments need not be planar and could be configured in other shapes such as arcs, for example.

As can be seen, the splitting blade 126 is oriented generally along the working plane 118 as defined by the motion of the crossheads (see, FIG. 1). The splitting blade 126 has two ends 126*a* and 126*b*, each of which is optionally bifurcated into end segments 127*a,* 128*a,* and 127*b,* 128*b*. It will be understood that such bifurcations will produce a block that has rounded side facing edges, which create a more roughened or "weathered" look. As shown most clearly in FIG. 6, the blade segments 122 may be oriented in a generally rounded or curved configuration in order to produce split blocks with curved front facings having a weathered or roughened look.

While preferred embodiments of the present invention have been shown and described, it should be understood that various changes, adaptations, and modifications may be made therein without departing from the spirit of the invention. Changes may be made in details, particularly in matters of shape, size, material, and arrangement of parts without exceeding the scope of the invention. Accordingly, the scope of the invention is as defined in the language of the appended claims.

What is claimed is:

1. A tool for splitting a block of material into at least two blocks, the tool arranged and configured for reciprocal motion along a path that defines a splitting plane, the tool comprising:

a support;

a first splitter segment having a first edge, the first edge spaced a first predetermined distance from the support;

a second splitter segment having a second edge, the second edge spaced a second predetermined distance from the support;

wherein the first and second splitter segments are arranged so that the respective first and second edges are disposed adjacent to each other in a generally linear fashion to form a substantially continuous blade for splitting the block into at least two blocks;

wherein each of the first and second edges of said first and second splitter segments are angled with respect to said splitting plane;

whereby the substantially continuous blade is able to form a roughened, non-faceted surface.

2. The tool of claim 1, wherein the first edge is substantially linear.

3. The tool of claim 2, wherein the second edge is substantially linear.

4. The tool of claim 1, wherein the first edge and the second edge are substantially the same length.

5. The tool of claim 1, wherein the first and second predetermined distances are substantially the same.

6. The tool of claim 1, further comprising a third splitter segment having a third edge, with the third edge spaced a third predetermined distance from the support, the first, second, and third splitter segments arranged so that each of the respective first, second, and third edges are angularly disposed with respect to the splitting plane, with the first, second, and third edges forming a substantially continuous blade for splitting the block into at least two blocks.

7. The tool of claim 6, wherein the splitter segments lie generally along the splitting plane in contiguous, side-by-side contact.

8. A tool for splitting a block of material into at least two blocks, the tool arranged and configured for reciprocal motion in a path that defines a splitting plane, the tool comprising:

a support;

a first splitter segment having a first splitting edge; the first splitter segment being secured to the support so that the first splitting edge is positioned a first predetermined angular orientation with respect to said splitting plane; and a second splitter segment having a second splitting edge, the second splitter segment being secured to said support so that the second splitting edge is positioned at a second, predetermined angular orientation with respect to said splitting plane, the first and second splitter segments being arranged so that the first and second splitting edges form a substantially continuous and generally linear blade that is able to form a roughened, random appearing surface when splitting the block into at least two blocks.

9. The tool of claim 8, wherein the first splitting edge and the second splitting edge are angled with respect to each other.

10. The tool of claim 8, wherein the first splitting edge is substantially linear.

11. The tool of claim 10, wherein the second splitting edge is substantially linear.

12. The tool of claim 8, wherein the first splitting edge and the second splitting edge are substantially the same length.

13. The tool of claim 8, wherein the first and second splitting edges are spaced the same distance from the support.

14. A tool for splitting a block of material into at least two blocks, the tool arranged and configured for reciprocal motion along a path that defines a splitting plane, the tool comprising:

a support; and, a plurality of at least four splitter segments each having a material working edge, the splitter segments operatively connectable to the support and arranged so that the material working edges are in a side-by-side relation and form first and second substantially continuous splitting blades;

wherein portions of the first and second splitting blades share at least one splitter segment between them, and wherein the first and second splitting blades formed by the material working edges are generally arcuate relative to said splitting plane;

wherein the splitter segments alternately angle in opposite directions with respect to each other and the splitting plane;

whereby the substantially continuous blades are able to form roughened, non-faceted surfaces.

15. A tool for splitting a block of masonry into at least two blocks, the tool being constructed and arranged for reciprocal motion along a path defining a splitting plane, the tool comprising:

a support;

a plurality of at least three splitter segments each having a splitting edge, the splitter segments being fixed to the support and arranged so that the splitting edges are in substantially side-by-side relation and form a substantially continuous splitting blade; and, the splitter segments alternately angling in opposite directions with respect to each other and with respect to the splitting plane in a corrugated configuration;

whereby the substantially continuous blade is able to form a roughened, and substantially non-faceted surface.

16. The tool of claim 15, wherein the splitter segments are in abutting contact with each other so as to form an uninterrupted splitting blade.

17. A tool for forming a substantially non-faceted surface on a masonry block, the tool comprising:

an elongated support having a longitudinal axis that is substantially aligned with a splitting plane; and, a plurality of splitter segments attached to the elongated support, with each splitter segment having a splitting edge, the splitter segments arranged on the elongated support so that their respective splitting edges are in substantial end-to-end relation to form a substantially continuous splitting blade, with the splitting edge of each splitter segment being angled with respect to longitudinal axis of the elongated support;

whereby when the substantially continuous splitting blade of the tool moves along the splitting plane and engages a masonry block, the splitting blade fractures the block and forms a substantially non-faceted surface.

18. The tool of claim 17, wherein at least one of the splitter segments is removably attached to the elongated support.

* * * * *